US007311396B2

(12) United States Patent
Kwon et al.

(10) Patent No.: US 7,311,396 B2
(45) Date of Patent: Dec. 25, 2007

(54) BARCODE MARKING METHOD AND APPARATUS FOR ELECTRO-LUMINESCENCE DISPLAY DEVICE

(75) Inventors: Seung Ho Kwon, Seoul (KR); Byung Soo Kim, Seoul (KR); Jin Ho Sunwoo, Kumi-si (KR); Yoon Heung Tak, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 313 days.

(21) Appl. No.: 10/960,968

(22) Filed: Oct. 12, 2004

(65) Prior Publication Data

US 2005/0078164 A1 Apr. 14, 2005

(30) Foreign Application Priority Data

Oct. 13, 2003 (KR) ..... 10-2003-0071075

(51) Int. Cl.
*B41J 2/01* (2006.01)
*B41J 3/00* (2006.01)

(52) U.S. Cl. ..... 347/107; 347/2

(58) Field of Classification Search ..... 347/107, 347/101, 2, 105, 104
See application file for complete search history.

(56) References Cited

U.S. PATENT DOCUMENTS 4,138,620 A * 2/1979 Dickson ..... 313/1
4,645,970 A * 2/1987 Murphy ..... 313/509
5,118,369 A * 6/1992 Shamir ..... 156/64
5,206,490 A * 4/1993 Petigrew et al. ..... 347/100
5,301,982 A * 4/1994 Brotz ..... 283/83
5,309,060 A * 5/1994 Sharpless et al. ..... 313/511
5,471,773 A * 12/1995 Hoffman ..... 40/544
5,521,709 A * 5/1996 Bossen et al. ..... 358/296
5,583,394 A * 12/1996 Burbank et al. ..... 313/498
5,838,644 A * 11/1998 Yoneda et al. ..... 368/232
6,270,213 B1 * 8/2001 Sansone et al. ..... 347/100
6,439,688 B1 * 8/2002 Vives et al. ..... 347/43
6,523,951 B2 * 2/2003 Takeya et al. ..... 347/107
6,557,898 B2 * 5/2003 Kissinger et al. ..... 283/70
6,937,004 B2 * 8/2005 Ohazama ..... 324/158.1
2001/0048968 A1 * 12/2001 Cox et al. ..... 427/162
2002/0001026 A1 * 1/2002 Ishikawa et al. ..... 347/101
2004/0146742 A1 * 7/2004 Hsu et al. ..... 428/690
2005/0082820 A1 * 4/2005 Nelson et al. ..... 283/83
2005/0100660 A1 * 5/2005 Ito et al. ..... 427/66

FOREIGN PATENT DOCUMENTS

JP 5-67549 A 3/1993
JP 11-258563 A 9/1999
JP 2000243554 A * 9/2000

(Continued)

*Primary Examiner*—Stephen Meier
*Assistant Examiner*—Leonard Liang
(74) *Attorney, Agent, or Firm*—Birch, Stewart, Kolasch & Birch, LLP

(57) ABSTRACT

The invention relates to a barcode marking method and apparatus for an electro-luminescence display device. According to the barcode marking method and apparatus for an electro-luminescence display device of the present invention includes, an information barcode is marked on the electro-luminescence display devices by using the ink jetted from the ink-jet head while moving at least any one of the stage and the ink-jet head.

23 Claims, 6 Drawing Sheets

FOREIGN PATENT DOCUMENTS

| | | | | |
|---|---|---|---|---|
| JP | 2002-43053 | A | | 2/2002 |
| JP | 2002-303843 | A | | 10/2002 |
| JP | 2003-42900 | A | | 2/2003 |
| JP | 2003243156 | A | * | 8/2003 |
| JP | 2004337726 | A | * | 12/2004 |

* cited by examiner

BARCODE MARKING METHOD AND APPARATUS FOR ELECTRO-LUMINESCENCE DISPLAY DEVICE

This application claims the benefit of Korean Patent Application No. P2003-71075 filed in Korea on Oct. 13, 2003, which is hereby incorporated by reference.

BACKGROUND OF THE INVENTION

1. Field of the Invention

This invention relates to a barcode marking method for an electro-luminescence display device, and more particularly, to a barcode marking method and apparatus for an electro-luminescence display device capable of improving a production yield.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD) device, a field emission display (FED) device, a plasma display panel (PDP), an electro-luminescence (EL) display and the like.

Among these, the EL display device is a spontaneous light-emitting device capable of light-emitting a phosphorous material by a re-combination of electrons with holes. The EL display device is generally classified into an inorganic EL device using an inorganic compound as the phosphorous material and an organic EL device using an organic compound as the phosphorous material. The EL display device has many advantages of a low voltage driving, a self-luminescence, a thin-thickness, a wide viewing angle, a fast response speed and a high contrast, etc. such that it can be highlighted into a post-generation display device.

Meanwhile, it is common that the EL display device has not any marks thereon, e.g., on its sectional surface, but it is current trend to mark an information barcode on the EL display device for the identification. According to the international organization for standardization ISO for, it is required that the information barcode should be marked on the sectional surface of the EL display device. Accordingly, in order to mark the information barcode on the sectional surface of the EL display device, there are employed several methods including a manual labor using a marking pen, a method of etching a substrate of the EL display device by a laser to directly mark the information barcode inside the EL display device, and a method of sticking a sticker having a printed information barcode on a rear surface of the EL display device.

However, the manual labor using the marking pen is applicable to a large-sized display device, but it is difficult to applicable to such a small-sized display device as an EL display device. Also, since the manual labor is manually performed, there is a problem that a production yield is deteriorated. The method of etching the substrate of the EL display device by the laser has a disadvantage that a repair of the EL display device is impossible when an information barcode is wrongly marked, or when a badness is occurred during the marking process of the information barcode. Further, the method of sticking the sticker having the printed information barcode on the rear surface of the EL display device has a disadvantage that the sticker is easily detached from the EL display device and the repair is impossible as the laser method.

SUMMARY OF THE INVENTION

Accordingly, it is an object of the present invention to provide a barcode marking method and apparatus for an electro-luminescence display device capable of improving a production yield.

In order to achieve these and other objects of the invention, a barcode marking method for an electro-luminescence display device, using an ink-jet head and a stage which are installed movable respectively, includes: disposing a substrate having a plurality of electro-luminescence display devices on the stage; and marking an information barcode on the electro-luminescence display devices by using the ink jetted from the ink-jet head while moving at least any one of the stage and the ink-jet head.

The stage is moved along any one of X-axis direction and Y-axis direction.

The ink-jet head is moved along any one of X-axis direction and Y-axis direction, which are crossed from a moving direction of the stage.

The information barcode includes: a date information representing the time when the electro-luminescence display device is made; and a property information representing the property of each the electro-luminescence display device.

The information barcode includes: a first barcode; and a second barcode different shape from the first barcode.

The first barcode includes a two-dimension (2D) letter shape, and the second barcode includes a text.

The first and the second barcodes are marked together with on the same electro-luminescence display device.

Each electro-luminescence display device includes an organic light-emitting layer and a packaging plate for encapsulating the organic light-emitting layer.

The first and the second barcodes are marked on the packaging plate.

A barcode marking apparatus for an electro-luminescence display device, includes: an ink-jet head which is installed to be movable and can jet the ink; and a stage, installed to be movable toward a moving direction crossing a moving direction of the ink-jet head, for disposing a substrate having a plurality of electro-luminescence display devices thereon, wherein an information barcode is marked on the electro-luminescence display devices by using the ink jetted from the ink-jet head while moving at least any one of the stage and the ink-jet head.

A barcode marking apparatus for an electro-luminescence display device, includes: a stage, installed to be movable toward a Y-axis direction, for being disposed a mother glass in which a column of a plurality of electro-luminescence display devices is formed along a X-axis direction and a row of a plurality of electro-luminescence display device is formed along the Y-axis direction; and an ink-jet head, installed to be movable toward the X-axis direction and jetting the ink, for marking together with at least two or more information on each the electro-luminescence display device.

At least the two or more information are marked in a text shape together with a two-dimension (2D) letter shape on each the electro-luminescence display device.

At least the two or more information are marked on the packaging plate.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 1 to 5B.

Figure 1:
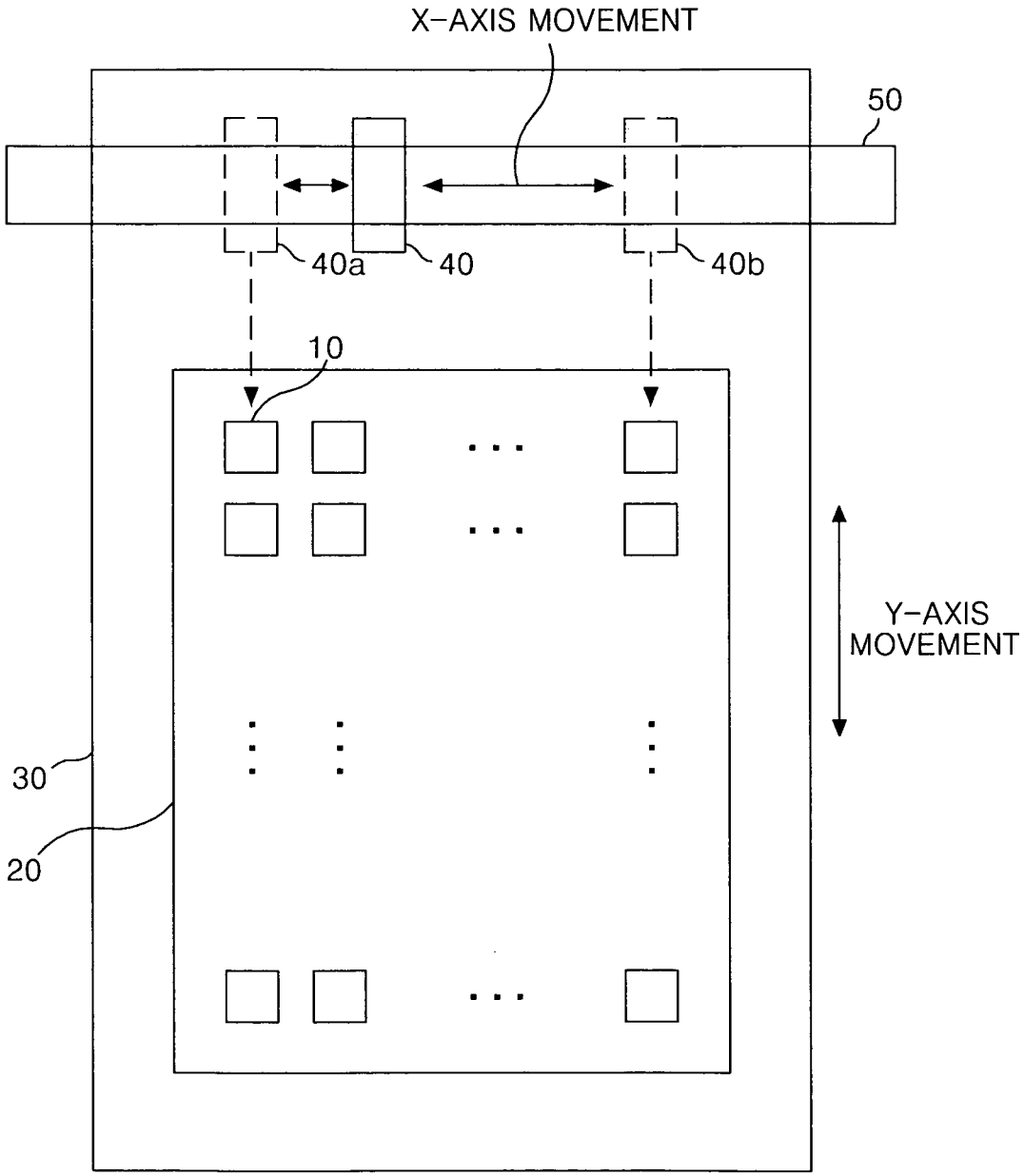
FIG. 1 is a block diagram representing a barcode marking device for an electro-luminescence display device according to an embodiment of the present invention.

FIG. 1 is a block diagram representing a barcode marking device for an electro-luminescence display device according to an embodiment of the present invention.

Referring to FIG. 1, the barcode marking device for an electro-luminescence display device according to the embodiment of the present invention includes: a stage 30; a substrate 20 mounted on the stage 30; a plurality of EL display devices 10 formed on the substrate 20; an ink-jet marker for marking an information barcode in the EL display devices 10; and an ink-jet driver 50 for supporting and driving the ink-jet marker 40.

Figure 2:
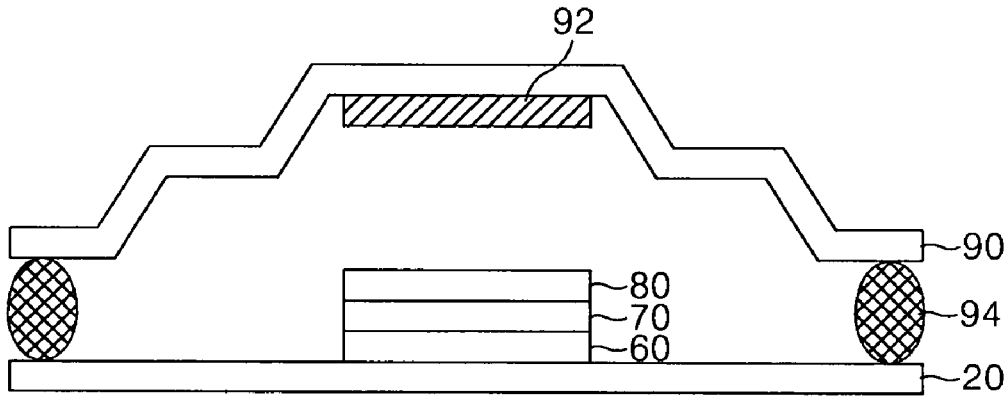
FIG. 2 is a sectional view fully illustrating the electro-luminescence display device shown in FIG. 1.

The EL display devices 10 includes an anode electrode 60 with a transparent electrode pattern on the substrate 20 and an organic light-emitting layer 70 stacked on the anode electrode 60, as shown in FIG. 2. A cathode electrode 80 as a metal electrode is formed on the organic light-emitting layer 70. Also, since the organic light-emitting layer 70 is apt to be damaged by moisture and oxygen in the atmosphere, a packaging plate 90 is formed in order to protect the organic light-emitting layer 70. The packaging plate 90 is made of material such as glass, plastic or canister. The packaging plate 90 includes a fist horizontal surface on which a sealant 94 is applied, a second horizontal surface having a designated step height from the first horizontal surface; and a third horizontal surface having a designated step height from the second horizontal surface.

A getter 92 is attached on a bottom surface of the third horizontal surface in the packaging plate 90 to absorb the moisture and the oxygen.

The getter 92 includes a powder getter such as barium oxide (BaO) or calcium oxide (CaO) enveloped by a polyethylene system package. A net is adhered on one side of the packaging paper in order to make the oxygen and the moisture to go in and out.

Figure 3:
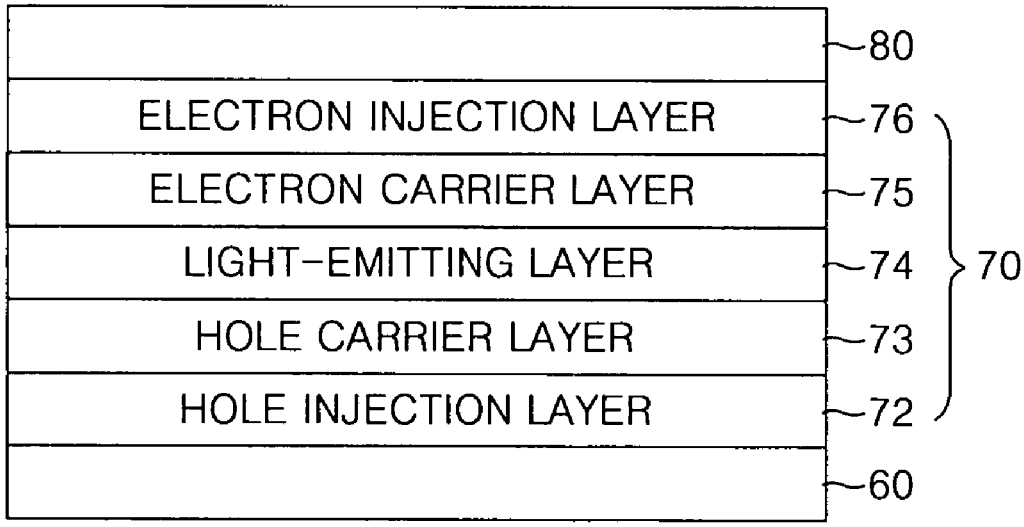
FIG. 3 is block diagram illustrating an organic light-emitting layer in the electro-luminescence display device shown in FIG. 2.

Herein, the organic light-emitting layer 70 stacked between the anode electrode 60 and the cathode electrode 80 includes an electron injection layer 76, an electron carrier layer 75, a light-emitting layer 74, a hole carrier layer 73, and a hole injection layer 72, as shown in FIG. 3.

When a voltage is applied between the anode electrode 60 and the cathode electrode 80, electrons produced from the cathode electrode 80 are moved, via the electron injection layer 76 and the electron carrier layer 75, into the light-emitting layer 74. Moreover, holes produced from the anode electrode 60 are moved, via the hole injection layer 72 and the hole carrier layer 73, into the light-emitting layer 74. Thus, the electrons and the holes supplied from the electron carrier layer 75 and the hole carrier layer 73, respectively, are collided at the light-emitting layer 74, so that they are recombined to thereby generate light. This light is emitted, via the anode electrode 60 of the transparent electrode, into the exterior to thereby represent a picture. Since a light-emitting brightness of the organic EL device is in proportion to a supplied current rather than in proportion to a voltage applied to both end of the EL device, the anode electrode is commonly connected to a constant current source.

The stage 30 is supported by a stage driver(not shown) and is moved along a Y-axis direction. After the substrate 20 having the EL display devices 10 formed thereon is disposed on the stage 30, the stage 30 is sequentially moved along the Y-axis direction in order to mark the information barcode by using the ink-jet marker 40 on the EL display devices 10 arranged on row and column basis on the substrate 20. More specifically, after the information barcode is marked on all of the EL display devices 10 arranged in one row in the substrate 20, the stage 30 is moved along the Y-axis direction in order to mark the information barcode on the other EL display device 10 arranged in the next row.

The ink-jet marker 40 functions to mark the information barcode for the EL display device by using an ink-jet system on the packaging plate 90 of the EL display devices. The information barcode for the EL display devices 10 includes a various of information on a date representing the time when the EL display device 10 is made, a property of the EL display device 10 and the like. At this time, the information barcode for the EL display devices 10 has the information different from each other in order to identify the respective EL display devices 10.

Figure 4:
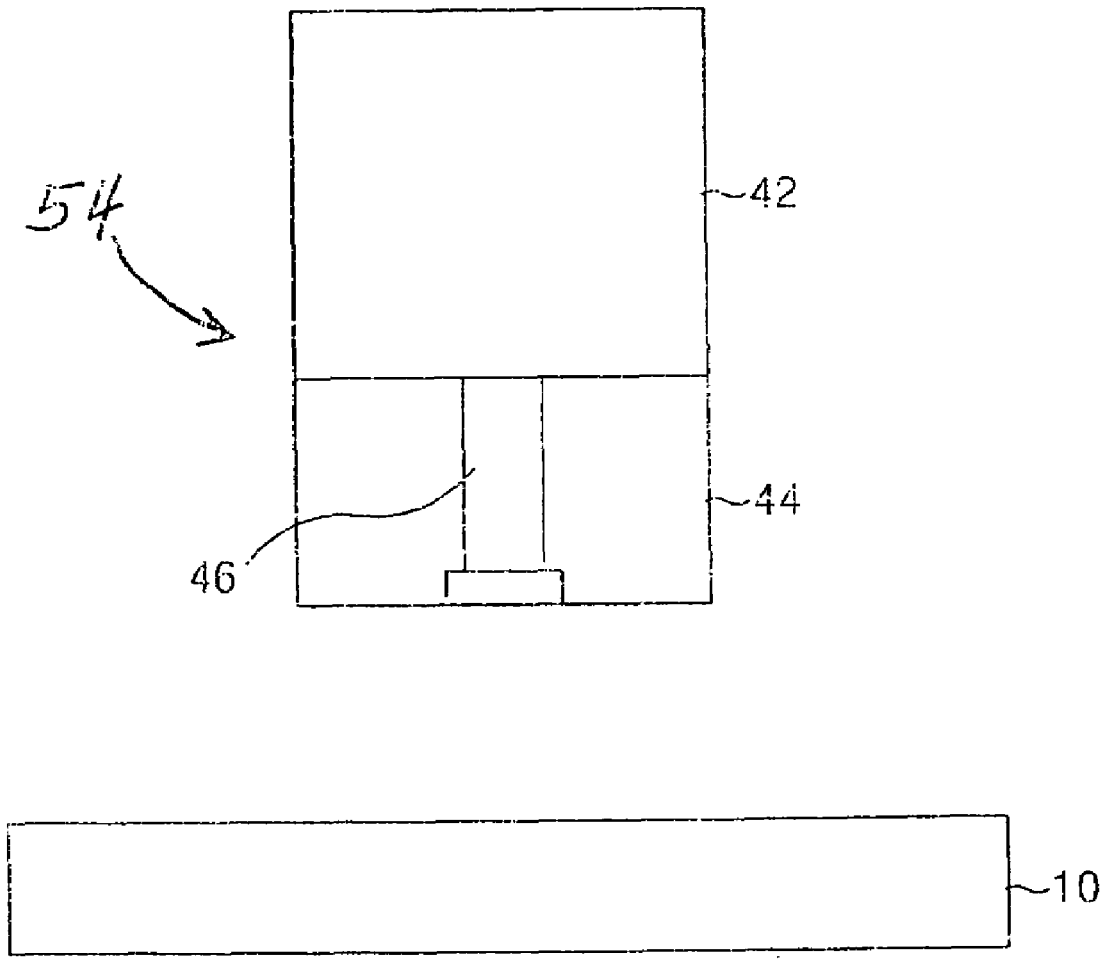
FIG. 4 shows a detailed ink-jet marker in the barcode marking device for the electro-luminescence display device shown in FIG. 1.

Meanwhile, the ink-jet system includes a thermal system or a piezoelectric system. The piezoelectric system among these is mainly used. The ink-jet marker 40 for the piezoelectric system 50 includes a vessel 42 for containing a material to be jetted, and an ink-jet head 44 for jetting the material supplied from the vessel 42, as shown in FIG. 4. The vessel 42 is filled with the ink, and the ink-jet head 54 is provided with a piezoelectric element and a nozzle 46 for jetting the ink contained in the vessel 42. If a voltage is applied to the piezoelectric element, then a physical pressure is produced to repeatedly cause a contraction and a relaxation of a flow path between the vessel 42 and the nozzle 46. Owing to this repeated contraction and relaxation, the ink is jet through the nozzle 46. The ink-jet marker 40 jets the ink to the EL display devices 10 while being moved by the ink-jet driver 50 along a X-axis direction to thereby mark the information barcode for the EL display devices 10. Herein, the ink-jet marker 40 is controlled by a system(not shown) to mark a desired information to each of the EL display devices 10.

A marking method using a barcode marking device for the EL display device will be described as follows in detail. First of all, the substrate 20 having the EL display devices 10 is disposed on the stage 30. The EL display devices 10 arranged in a first column is located at a place in which the ink-jet marker 40 is located by moving the stage 30 along the Y-axis direction. Then, the desired information barcode is marked on each of the EL display devices 10 by the ink-jet marker 10 moving from a first location 40*a* to a second location 40*b* along the X-axis direction by the ink-jet driver 50. Herein, the first location 40*a* corresponds to a location of a first EL display device 10 arranged in one row on the substrate 20 having the EL display devices 10. The second location 40*b* corresponds to a location of a last EL display device 10 arranged in the row on the substrate 20. When the information barcode is marked on all of the EL display devices 10 arranged in the first row, the ink-jet marker 40 located in the second location 40*b* is moved again to the first location 40*a*. And then, the stage 30 is moved along the Y-axis direction on one column basis so that the EL display devices 10 arranged in a subsequent row is located at a place in which the ink-jet marker 40 is located. Then, the information barcode is marked on each of the EL display devices 10 by the ink-jet marker 40 moving from the first location 40*a* to the second location 40*b* along the X-axis direction by the ink-jet driver 50. In this way, the above operation is repeated until the information barcode is marked on all of the EL display devices 10 arranged in a last row.

Figure 5A:
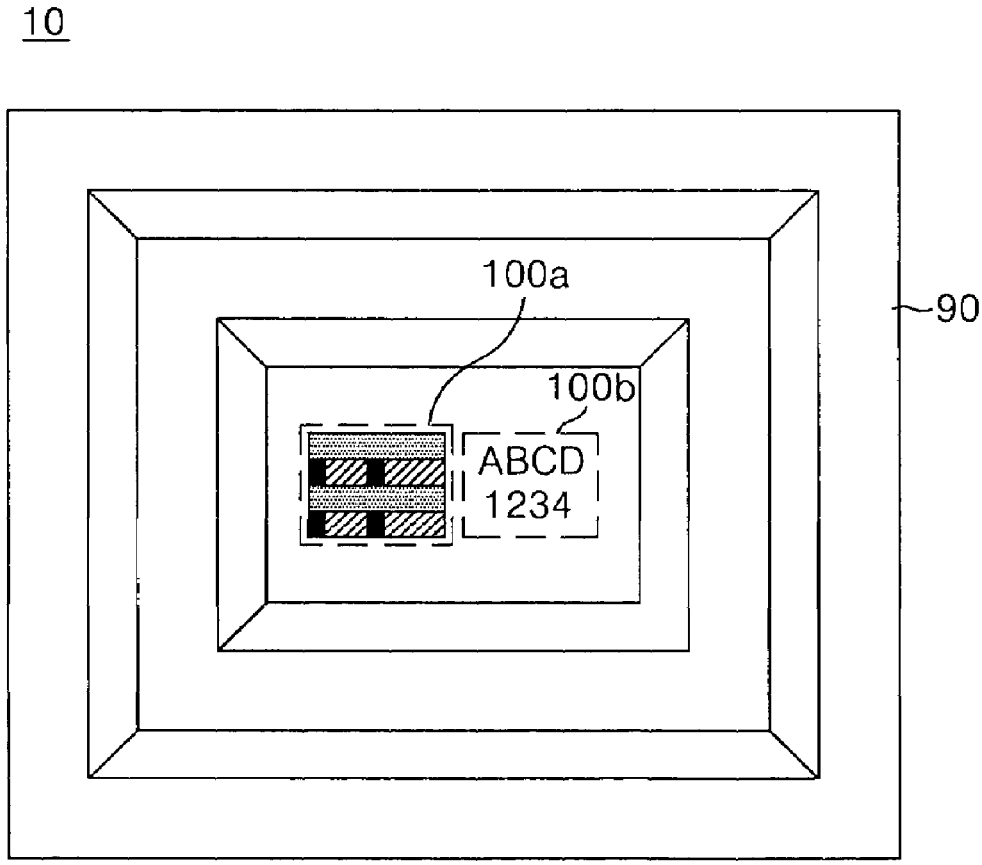
FIGS. 5A to 5B illustrate an information barcode marked in the electro-luminescence display device by using the barcode marking device for the electro-luminescence display device shown in FIG. 1.
Figure 5B:
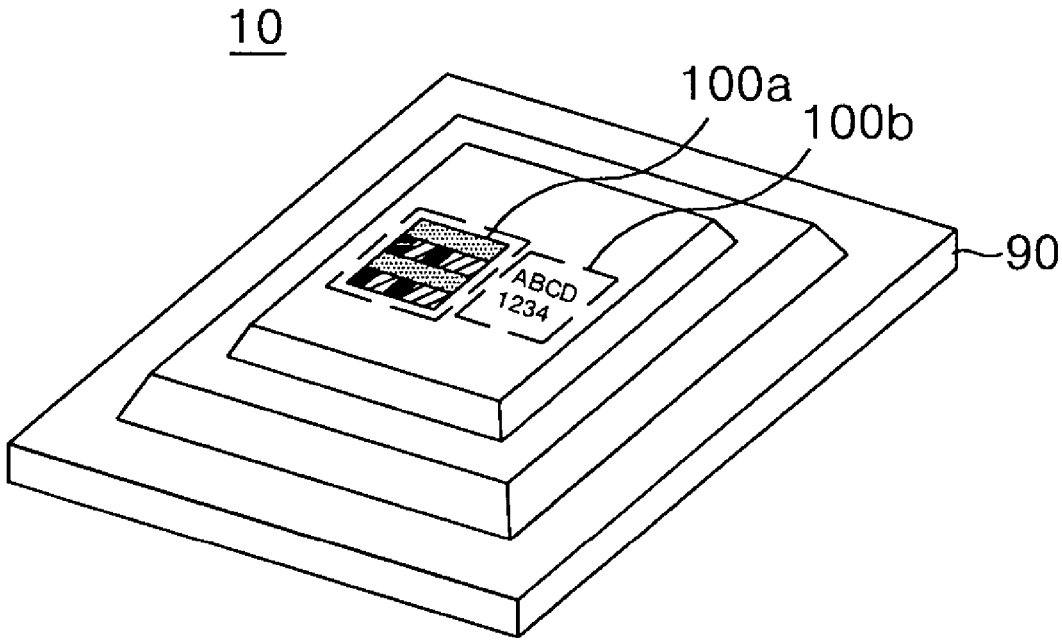

Alternatively, the present invention is made to mark two information barcodes having same information on the packaging plate 90 of the EL display device provided for a badness of the information barcode marked on the EL display device 10. In other words, as shown in FIGS. 5A and 5B, the two information barcodes includes a two-dimension (2D) barcode 100*a* and a text barcode 100*b*. The two-dimension (2D) barcode 100*a* and the text barcode 100*b* are marked on the packaging plate 90 of the EL display device by the ink-jet system in accordance with the present invention.

As described above, the information on the EL devices is stored by the two-dimension (2D) barcode 100*a* and the text barcode 100*b* when the information barcode for the EL display device is marked by the barcode marking device for the EL display device according to the present invention. Therefore, it is easy to manage the EL display devices. Also, when a marking badness is occurred, the marking badness can be removed by using a solvent. Thus, it has an advantage that a repair is possible. Such an ink-jet method has an advantage that the time required to mark the information barcode is saved as compared with the method directly sticking the sticker through the use of the manual labor by a worker or the method etching the substrate by using the laser to mark the information barcode. Thus, it is profitable in a production yield.

As describe above, according to the barcode marking method and apparatus of the electro-luminescence display device of the present invention, the information barcode of the EL display device is marked through using the ink, to thereby remove the marking badness when the marking badness is occurred. As a result, a repair is possible, as well as, the time required to mark the information barcode is saved. Thus, it is possible to improve a production yield thereof.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A barcode marking method for an organic EL device, comprising: disposing a plurality of organic EL devices, each device including a first electrode, a second electrode, and an organic light-emitting layer formed between the first and second electrodes, on a stage; and marking an information barcode by jetting an ink from an ink-jet head, installed to be movable, on the organic EL devices.

2. The barcode marking method according to claim 1, further comprising moving the stage along any one of X-axis direction and Y-axis direction.

3. The barcode marking method according to claim 2, further comprising moving the ink-jet head along any one of X-axis direction and Y-axis direction, which are crossed from a moving direction of the stage.

4. The barcode marking method according to claim 1, wherein the information barcode includes:

a date information representing the time when the organic EL device is made; and a property information representing the property of each of the organic EL devices.

5. The barcode marking method according to claim 1, wherein, the information barcode includes:

a first barcode; and a second barcode different in shape from the first barcode.

6. The barcode marking method according to claim 5, wherein, the first barcode includes a two-dimension (2D) letter shape, and the second barcode includes a text.

7. The barcode marking method according to claim 5, further comprising marking the first and the second barcodes together on the same organic EL device.

8. The barcode marking method according to claim 7, wherein, each organic EL device includes a packaging plate for encapsulating the organic light-emitting layer, and the first and the second barcodes are marked on the packaging plate.

9. The method of claim 1, wherein the information barcode is marked directly on the organic EL devices.

10. A barcode marking apparatus for an organic EL device, comprising:

an ink-jet head which is installed to be movable in a direction and can jet the ink; and a stage, installed to be movable in a direction crossing the moving direction of the ink-jet head, for disposing a plurality of organic EL devices, each device including a first electrode, a second electrode, and an organic light-emitting layer formed between the first and second electrodes, thereon, wherein an information barcode is marked on the organic EL devices by using the ink jetted from the ink-jet head while moving at least any one of the stage and the ink-jet head.

11. The barcode marking apparatus according to claim 10, further comprising means for moving the stage along any one of X-axis direction and Y-axis direction.

12. The barcode marking apparatus according to claim 11, further comprising means for moving the ink-jet head along any one of X-axis direction and Y-axis direction, which are crossed from a moving direction of the stage.

13. The barcode marking apparatus according to claim 10, wherein the information barcode includes:

a date information representing the time when the organic EL device is made; and a property information representing the property of each organic EL device.

14. The barcode marking apparatus according to claim 10, wherein, the information barcode includes:

a first barcode; and a second barcode different in shape from the first barcode.

15. The barcode marking apparatus according to claim 14, wherein, the first barcode includes a two-dimension (2D) letter shape, and the second barcode includes a text.

16. The barcode marking apparatus according to claim 14, wherein: the first and the second barcodes are located together on the same organic EL device.

17. The barcode marking apparatus according to claim 16, wherein, each organic EL device includes a packaging plate for encapsulating the organic light-emitting layer, and the first and the second barcodes are marked on the packaging plate.

18. The apparatus of claim 10, wherein the information barcode is located directly on the organic EL devices.

19. A barcode marking apparatus for an organic EL device, comprising: a stage, installed to be movable in a Y-axis direction, for supporting a mother glass in which a column of a plurality of organic EL devices is formed along an X-axis direction and a row of a plurality of organic EL devices is formed along the Y-axis direction, each of the column of the plurality of organic EL devices including a first electrode, a second electrode, and an organic light-emitting layer formed between the first and second electrodes; an ink-jet head, installed to be movable in the X-axis direction; and for jetting the ink, for marking at least two or more pieces of information on each organic EL device.

20. The barcode marking apparatus according to claim 19, wherein the information barcode includes:

a date information representing the time when the organic EL device is made; and a property information representing a characteristic of each organic EL device.

21. The barcode marking apparatus according to claim 19, wherein the at least two or more pieces of information have a text shape together with a two-dimension (2D) letter shape on each organic EL device.

22. The barcode marking apparatus according to claim 19, wherein each organic EL device includes a packaging plate for encapsulating the organic light-emitting layer; and at least the two or more pieces of information are marked on the packaging plate.

23. The apparatus of claim 19, wherein the information barcode is located directly on the organic EL devices.

* * * * *